US007380796B1

(12) United States Patent
Hinton

(10) Patent No.: US 7,380,796 B1
(45) Date of Patent: Jun. 3, 2008

(54) 3-D PORTABLE IMPULSE TARGET FOR ARCHERY

(76) Inventor: Tab D. Hinton, 9288 Highway 613, Lucedale, MS (US) 39452

( * ) Notice: Subject to any disclaimer, the term of this patent is extended or adjusted under 35 U.S.C. 154(b) by 9 days.

(21) Appl. No.: 11/481,283

(22) Filed: Jul. 5, 2006

(51) Int. Cl.
*F41J 3/00* (2006.01)

(52) U.S. Cl. ..... 273/408; 273/407

(58) Field of Classification Search ..... 273/403, 273/404, 407, 408
See application file for complete search history.

(56) References Cited

U.S. PATENT DOCUMENTS

| | | | |
|---|---|---|---|
| 2,812,947 | A | 11/1957 | Fatzinger |
| 3,163,418 | A | 12/1964 | Myers |
| 3,329,431 | A | 7/1967 | Roesner |
| 4,054,288 | A | 10/1977 | Perrine, Sr. |
| 4,203,600 | A | 5/1980 | Brown |
| 4,477,082 | A | 10/1984 | McKenzie |
| 4,643,434 | A | 2/1987 | Carlin |
| 5,168,649 | A | 12/1992 | Wright |
| 5,233,780 | A | 8/1993 | Overholt |
| 5,274,942 | A | 1/1994 | Lanius |
| 5,289,654 | A | 3/1994 | Denny |
| 5,383,671 | A | 1/1995 | Teets |
| 5,465,977 | A | 11/1995 | Mann |
| 5,503,403 | A | 4/1996 | Morrell |
| 5,676,378 | A | 10/1997 | West |
| 5,816,579 | A | 10/1998 | Broussard |
| 5,865,440 | A | 2/1999 | Pulkrabek |
| 5,901,491 | A | 5/1999 | Caldwell |
| 6,115,953 | A | 9/2000 | Wise |
| 6,550,773 | B2 | 4/2003 | McKenzie |
| 6,575,469 | B2 | 6/2003 | Love |
| 6,799,764 | B2 | 10/2004 | Ingold |
| 6,877,267 | B2 | 4/2005 | Burton |
| 6,925,745 | B1 | 8/2005 | Alessi |
| 6,926,281 | B1 | 8/2005 | Woock |
| 6,983,939 | B2 | 1/2006 | Pulkrabek |

*Primary Examiner*—Mark S Graham
(74) *Attorney, Agent, or Firm*—Robert J. Harter

(57) ABSTRACT

An unanchored 3-D portable archery target made of foam can withstand a 20 to 150-pound blow from an arrow without tipping completely over even though the target's weight (e.g., about 10 lbs.) is less than the arrow's force of impact. To achieve such surprising and unexpected results, the target employs a unique combination of weight, foam density, and a center of gravity that is counter-intuitively elevated to provide the target with a greater rotational moment of inertia. Although it would seem that an arrow with 800 in-lbs of kinetic energy should be capable of completely tipping over a target that requires only about 15 in-lbs of energy to tip over, the target's foam core has a density and gumminess that quickly dissipates most of the arrow's kinetic energy before the energy has time to tip the target over. A hollowed-out base underneath the target provides the target with greater stability.

11 Claims, 3 Drawing Sheets

3-D PORTABLE IMPULSE TARGET FOR ARCHERY

BACKGROUND OF THE INVENTION

1. Field of the Invention

The subject invention generally pertains to archery targets and more specifically to a 3-D archery target that is portable and provides some animal resemblance.

2. Description of Related Art

In the field of archery, there is an ever-increasing demand for bows and arrows that can provide faster and more powerful shots. With current technology, some compound bows can be made to release 800 in-lbs of energy to deliver an arrow that provides an impact of over 150 pounds of force. In target practice, such force might be more than a conventional target can withstand, particularly if an archer prefers practicing with broad heads or other hunting points rather than field points.

There are various ways of making a target capable of withstanding the impact of arrows. Perhaps the most obvious would be to simply specify the target's force limit. U.S. Pat. No. 4,643,434, for instance, provides a force equation that when applied to one of its embodiments (claim 11 of the '434 patent), the prescribed sideways force of the arrow is 7.5 lbs. Such a force capacity, however, is far too limited for modern archery equipment.

Another way of making a target capable of withstanding high impact is to make the target thick and bulky with a low center of gravity, as shown in U.S. Pat. No. 5,865,440. Maximizing the bulk of a target, however, often results in a box-like target that does not resemble an animal.

If a target is three-dimensionally contoured to resemble an animal, the target is typically anchored to the ground with spikes or some other suitable anchor. An example of such a target is disclosed in U.S. Pat. No. 5,383,671. The anchors, unfortunately, make it difficult to transport the target by vehicle, as the spikes might damage the vehicle, damage other items in the vehicle, or cause personal injury. Moreover, metal spikes tend to corrode, they can increase the target's assembly cost, and can damage an arrow if the arrow hits the anchor.

Consequently, a need exists for a high-impact 3-D target that is portable, resembles an animal, and can be readily set in place without anchors or tossed in a vehicle without damage or injury.

SUMMARY OF THE INVENTION

It is an object of the invention to provide a portable 3-D archery target that can withstand a 20 to 150-pound impact from an arrow without tipping completely over and without having to be anchored to the ground.

Another object of some embodiments is to provide a lightweight target with a foam core of a particular weight, thickness and density such that the target dissipates over 90% of an arrow's kinetic energy in the form of heat so that the remaining energy is insufficient to tip the target completely over on its side.

Another object of some embodiments is to provide a target that can withstand a brief 20 to 150-pound blow from an arrow without tipping completely over yet the target can be so lightweight and portable that it only takes about 10 pounds of sideways force to tip it over.

Another object of some embodiments is to provide a 3-D target that resembles an animal from one viewpoint and offers a generally flat geometric target area when viewed from another angle.

Another object of some embodiments is to provide an unanchored target that resembles an animal, wherein the target has a center of gravity that is above the midpoint of the target, thereby increasing the target's moment of inertia relative to the target's lower rear edge.

Another object of some embodiments is to increase a target's moment of inertia relative to the target's lower rear edge by providing the target with a relatively large upper section, a smaller lower section and an even smaller intermediate waist section interposed therebetween.

Another object of some embodiments is to provide a target with sufficient stability that it can withstand a continuous 3-pound horizontal force without tipping over, thus the target is not likely to be swayed by wind.

Another object of some embodiments is to make an archery target with a foam that when created under atmospheric pressure the foam freely expands to a density of about 6 lbs/ft$^3$; however, when created within a sealed mold that limits the foam's expansion (thereby creating pressure within the mold), the foam sets at a density of about 8 lbs/ft$^3$.

Another object of some embodiments is to provide a solid foam target with a slightly concave bottom surface so that the target can rest firmly on irregular ground.

Another object of some embodiments is to provide a solid foam target with a rope handle whose stranded ends are embedded within the foam, whereby the strands are tightly anchored in the foam, and the individual strands pose minimal risk of damage to a broad head that might strike the strands.

Another object of some embodiments is to provide a portable 3-D target that does not require anchors, and the target can resemble any of a variety of game animals including, but not limited to, a deer, bear, turkey, etc.

One or more of these and/or other objects of the invention are provided a portable 3-D archery target that can withstand a 20 to 150-pound blow from an arrow without the target having to be anchored to the ground even though the target's weight is less than the arrow's force of impact.

DESCRIPTION OF THE PREFERRED EMBODIMENT

Figure 1:
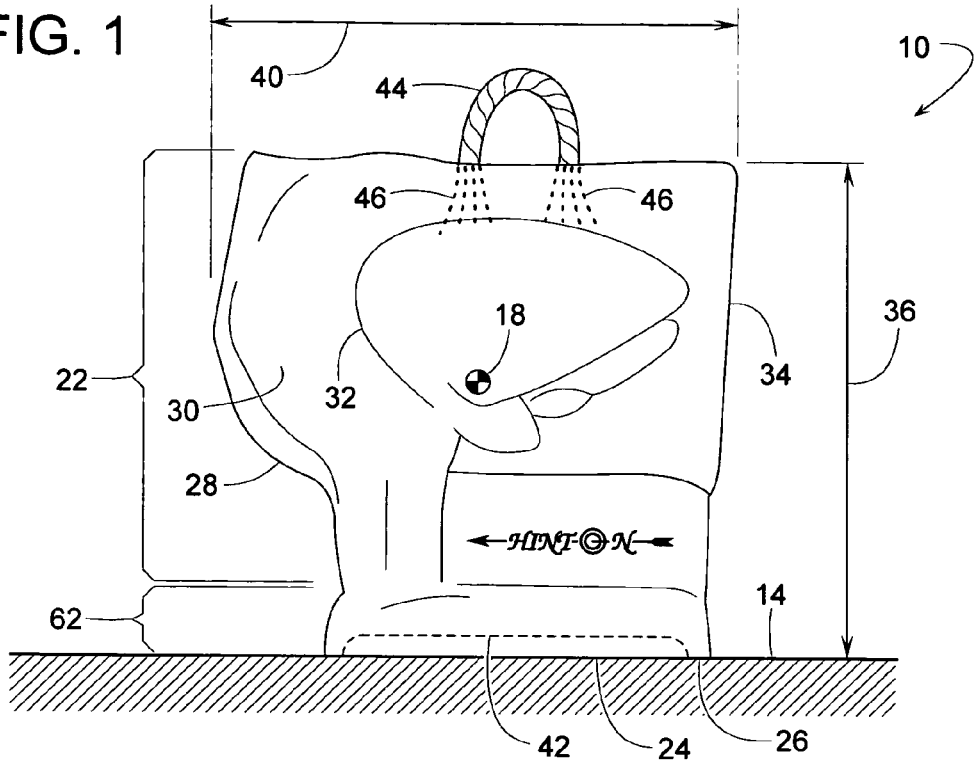
FIG. 1 is a side view of a 3-D archery target according to one embodiment of the invention.
Figure 2:
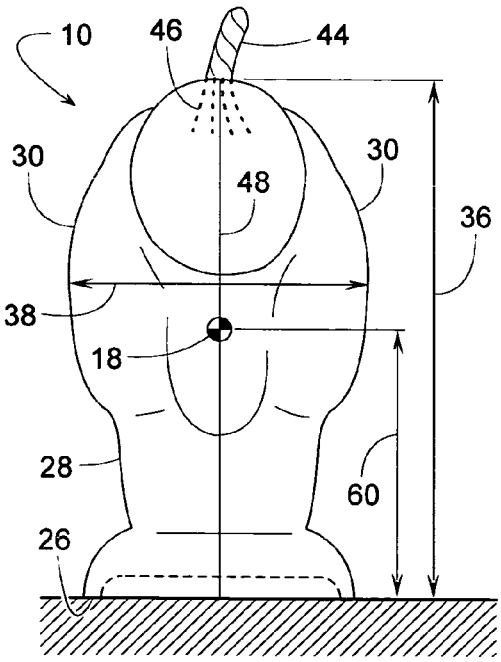
FIG. 2 is a left end view of FIG. 1.
Figure 3:
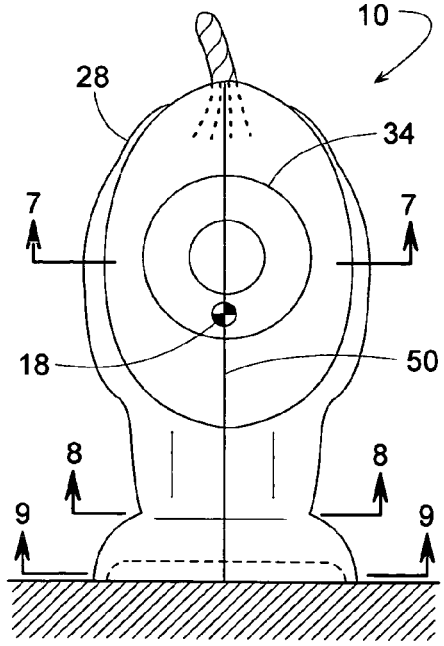
FIG. 3 is a right end view of FIG. 1.
Figure 4:
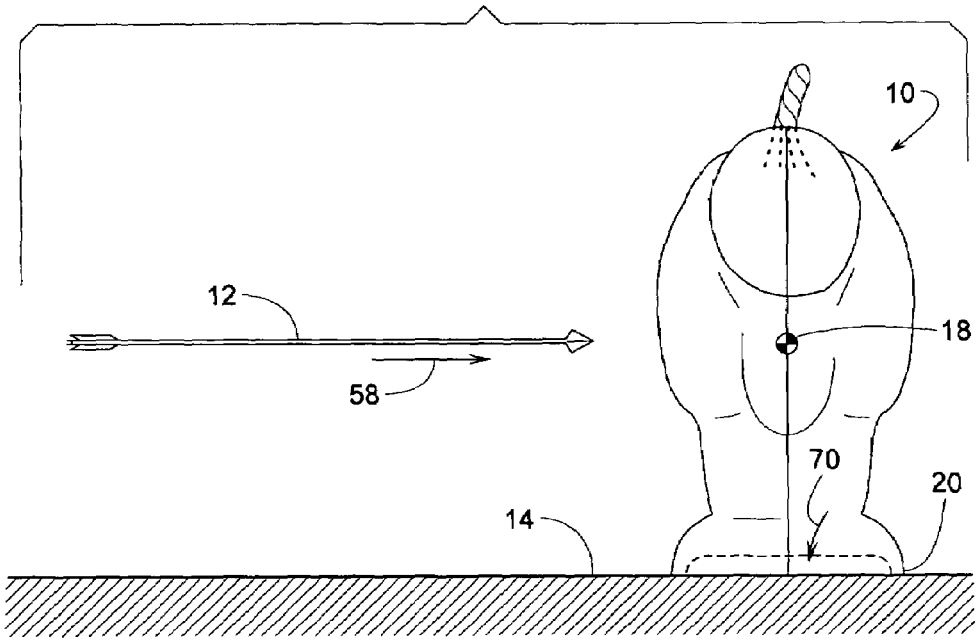
FIG. 4 is similar to FIG. 2 but showing an arrow about to strike the target.
Figure 5:
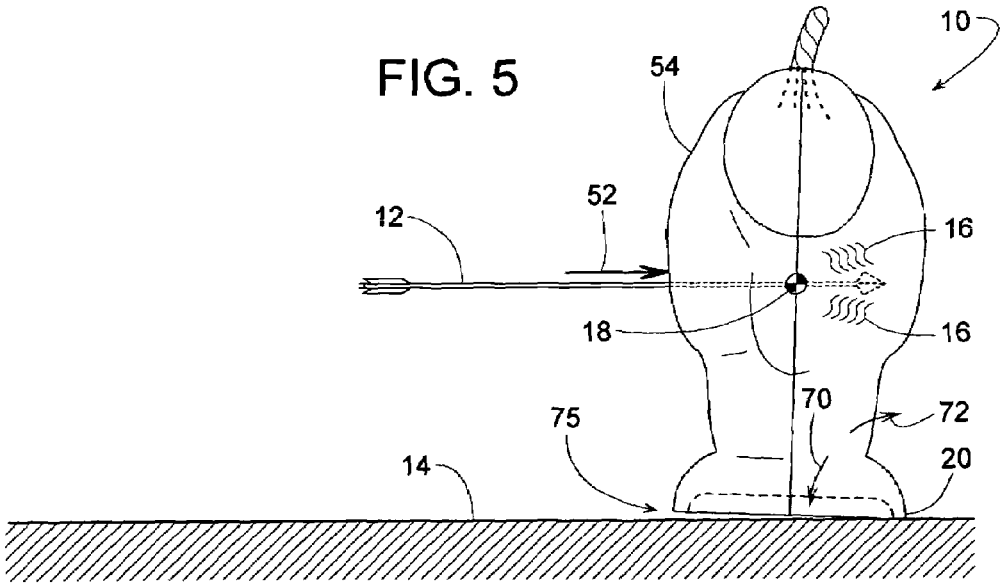
FIG. 5 is similar to FIG. 4 but showing the arrow after it struck the target.

A portable 3-D archery target 10, shown in FIGS. 1-6, can withstand a 20 to 150-pound blow from an arrow 12 without tipping completely over even though the target's weight (e.g., about 10 lbs.) is less than the arrow's force of impact. Moreover, target 10 can withstand such an impact.without having to be anchored to the ground or anchored to some other target-supporting surface 14.

An early prototype of target 10 had provisions for adding a stake that would anchor the target to the ground. Upon testing the prototype, however, it was discovered that the target did not require the anchoring stake, but instead the prototype could withstand blows that exceeded its own weight. This surprising and unexpected result was at first difficult to explain; however, further study identified unique design features that explain why target 10 performs so well.

Some of the more notable features of target 10 include: 1) a relatively dense, gummy foam core that can absorb nearly all of an arrow's kinetic energy and dissipate that energy in the form of heat 16 rather than absorbing the energy as physical work that could tip target 10 over; 2) a center of gravity 18 that instead of being kept as low as possible is counter intuitively elevated, thereby increasing the target's anti-tipping moment of inertia about a lower rear edge 20 of the target; 3) elevating the center of gravity 18 by forming an upper section 22 of target 10 as an enlarged 3-D body that resembles a game animal; and 4) hollowing out a bottom surface 24 of target 10 to create an outer peripheral rim 26 that can solidly rest upon ground surface 14 that may have some irregularities.

The target's actual size, weight, structure and appearance may vary; however, the currently preferred embodiment comprises a foam body 28 (resilient foam core) made of a single block of polyurethane foam cast with a three-dimensional curved outer surface 30 that resembles a front portion of a deer and some of its vital internal organs 32. Surface 30, of course, could alternatively be formed to resemble any other type of animal including, but not limited to, bear, turkey, etc. The terms, "3-D" and "three-dimensional" refer to surfaces that curve about three axes that are perpendicular to each other. On another side of the target, foam body 28 might also include an alternate geometric target area 34 (e.g., concentric rings, crosshairs, etc.) that is more planar than curved outer surface 30.

Foam 28 can be produced by various means including, but not limited to, pouring a two-part mixture into a mold cavity, wherein the mixture includes a part-A (about 42 fluid-ounces of isosynate or between 35 and 49 fluid ounces) and a part-B (about 100 fluid-ounces of polyol/resin). Part-A can be an FM600A and part-B can be an FM600B, both of which are products provided by Polyfoam Products, Inc. of Tomball, Tex. According to Polyfoam Products, Inc., a proper mixture of FM600A and FM600B can provide polyurethane foam having a density of 6 lbs/ft$^3$ if the mixture is free to react and expand in open atmosphere.

In this particular example, foam body 28 has an overall height 36 of about 18.5 inches, a width 38 of about 10 inches, and a length 40 of about 18.5 inches. To effectively stop arrow 12, foam body 28 has a total weight of about 10 pounds and has a density appreciably greater than 6 lbm/ft$^3$ (e.g., 6.2 to 10 lbm/ft$^3$) and preferably about 8 lbm/ft$^3$. This higher density is achieved by confining the expansion of the foam within a closed mold such that the expanding foam pressurizes itself before it fully sets.

Bottom surface 24 of foam body 28 is preferably formed with a hollow or concave section 42 that creates outer peripheral rim 26. Rim 26 can rest solidly upon target-supporting surface 14 so that target 10 is less susceptible to rocking due to irregularities in surface 14.

For portability, target 10 can be provided with a carrying handle 44. Although various types of handles might be acceptable, handle 44 is preferably a stranded rope with spread-out stranded ends 46 that become embedded in the foam as body 28 is being cast in a mold. The diverging strands 46 effectively anchor handle 44 to foam body 28, yet strands 46 do not pose a significant obstacle to an arrow that might penetrate target 10 in the vicinity of handle 44. To withstand the heat of the foam during the casting process, the rope is preferably made of a natural fiber such as manila, cotton or sisal; however, other materials are well within the scope of the inventions. Moreover, handle 44 does not necessarily have to be made of rope. The handle, for instance, could conceivably be integrally cast of the same foam that makes up the rest of foam body 28.

The mold used for casting foam body 28 can be a split clamshell design that creates a parting lines 48 and 50 at opposite ends of body 28. An additional parting line along the top of body 28 extends between lines 48 and 50 and tightly encircles each end of handle 44. The mold can include a removable bottom panel for forming bottom surface 24 and so that foam body 28 can be cast in an inverted position. As the foam expands, air within the mold is preferably vented to atmosphere until the expanding foam substantially fills the mold cavity. After that, the vent can be closed to limit further foam expansion and to achieve the desired foam density.

To provide target 10 with the ability to withstand a surprisingly high impact force 52 of arrow 12 against a front side 54 of body 28 without target 10 tipping completely over from an upright position (solid lines of FIG. 6) to a tipped-over position on its back side 56 (phantom lines of FIG. 6), the foam's weight and center of gravity 18 are such that target 10 has a favorable moment of inertia (about edge 20) combined with the foam body's ability to absorb most of the arrow's kinetic energy 58 in the form of heat 16. To achieve this, center of gravity 18 is at a height 60 that is preferably more than half of the foam body's overall height 36. In this particular example, height 60 is approximately 10 inches, and overall height 36 is about 18.5 inches.

Figure 7:
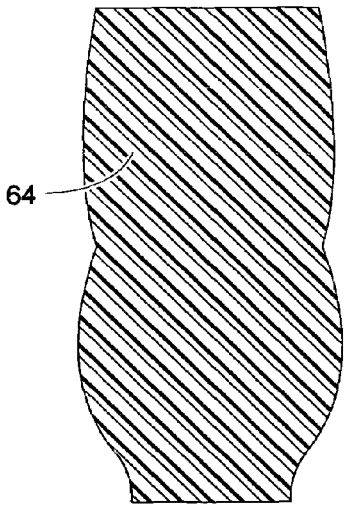
FIG. 7 is a cross-sectional view taken along line 7-7 of FIG. 3.
Figure 8:
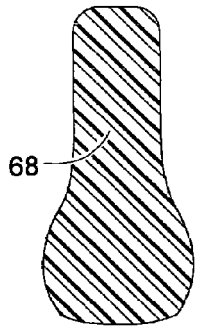
FIG. 8 is a cross-sectional view taken along line 8-8 of FIG. 3.
Figure 9:
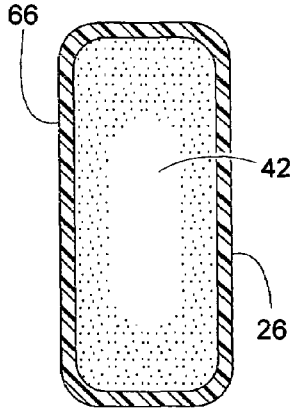
FIG. 9 is a cross-sectional view taken along line 9-9 of FIG. 3.

Center of gravity 18 is elevated due to foam body 28 comprising a lower section 62 and an enlarged upper section 22. Upper section 22 has a maximum horizontal cross-sectional area 64 (FIG. 7). Lower section 62 defines a horizontal base envelope 66 (entire area within an outer periphery 26 of FIG. 9), wherein base envelope 66 is smaller than maximum horizontal cross-sectional area 64. An intermediate horizontal cross-sectional area 68 (FIG. 8) is interposed between upper section 22 and lower section 62, wherein the intermediate horizontal cross-sectional area 68 is smaller than the maximum horizontal cross-sectional area 64 and is smaller than the horizontal base envelope 66. As a result, target 10 can be provided with a rotational moment of inertia (about lower rear edge 20) that is approximately 3 ft-lbs-sec$^2$. This rotational moment of inertia initially resists rotation of target 10 when it is first struck by arrow 12.

Figure 6:
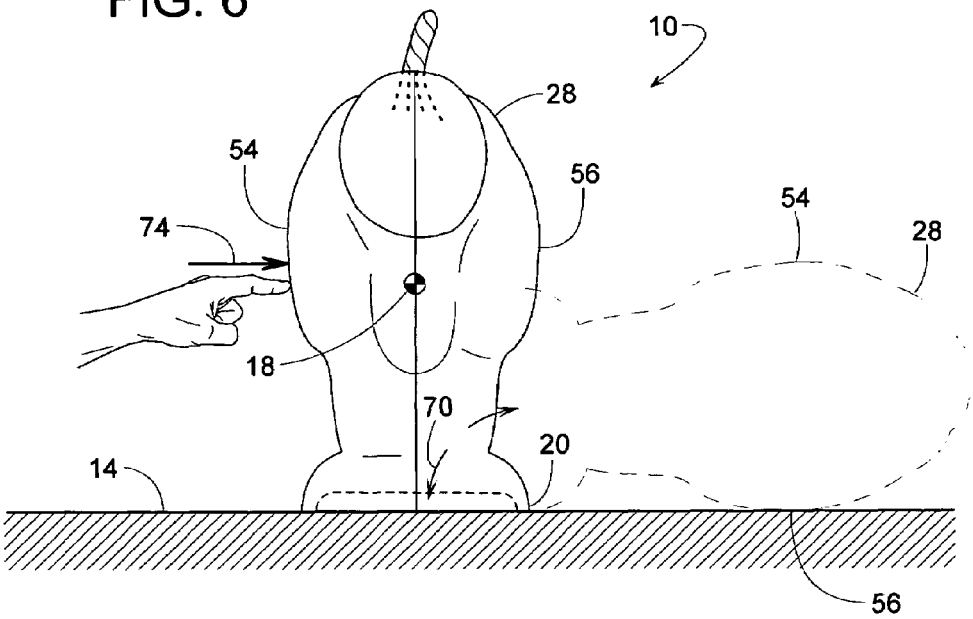
FIG. 6 is similar to FIGS. 3-5 but showing the target in an upright position (solid lines) and a tipped-over position (phantom lines).

In addition, an anti-tipping rotational moment 70 is created by the target's weight (about 10 lbs) since center of gravity 18 is horizontally offset about 5 inches relative to lower rear edge 20. Anti-tipping rotational moment 70 is about 50 inch-lbs (10 lbs×5 inches). Initially, anti-tipping rotational moment 70 plus the target's rotational moment of inertia oppose a tipping rotational moment 72 created by the arrow's force of impact (e.g., 20 to 150 lbs) times height 60 at which arrow 12 strikes target 10. If arrow 12 applies a 20-lb impact force 52 against target 10 at height 60, the tipping rotational moment 72 is about 200 in-lbs (20 lbs×10 in), which is greater than the anti-tipping moment of 50 in-lbs, thus a limited degree of tipping 75 might occur at initial impact. In fact, such an imbalance of moments would be sufficient to tip target 10 completely over to its tipped-over position if the tipping moment 72 of 200 in-lbs were applied for more than one second. Target 10 could freely fall to its tipped-over position once center of gravity 18 goes generally past lower rear edge 20 (center of gravity 18 might have to go slightly past edge 4 to compensate for the added weight of the relatively lightweight arrow). If, however, a horizontal force 74 of just 3 lbs were exerted against target 10 at height 60, as shown in FIG. 6, the anti-tipping moment 70 of 50 in-lbs could prevent the 3-lb force 74 from tipping target 10.

Although the rotational moment of inertia initially resists the impact of arrow 12, the rotational moment of inertia helps keep target 10 tipping after arrow 12 comes to rest within foam body 28. Moreover, since the tipping rotational moment 72 (about 200 in-lbs) is greater than the anti-tipping moment 70 (about 50 in-lbs), it becomes important that foam body 28 absorbs most of the arrow's kinetic energy 58 within a few millisecond (e.g., about 5 milliseconds) of the initial impact because otherwise the arrow's kinetic energy 58 and force of impact 52 might have sufficient time to completely tip target 10 over to its tipped-over position.

In some cases, the kinetic energy of arrow 12 can be over 800 in-lbs, while the physical energy it takes to tip target 10 completely over is only about 15 in-lbs. Consequently, foam body 28 needs to be of a quality (e.g., density, weight, gumminess, thickness) that enables foam body 28 to quickly absorb most of the arrow's kinetic energy in the form of heat or wasted energy, and preferably absorb over 90% of the kinetic energy in heat or wasted energy, and most preferably at least 98% of the kinetic energy in heat or wasted energy. The term, "wasted energy" refers to energy not used for tipping the target over.

Although the invention is described with reference to a preferred embodiment, it should be appreciated by those of ordinary skill in the art that various modifications are well within the scope of the invention. The scope of the invention, therefore, is to be determined by reference to the following claims.

The invention claimed is:

1. A portable 3-D archery target for absorbing an impact from an arrow moving with at least 100 in-lbs of kinetic energy such that the impact provides an impact force of at least 20 pounds of force and the arrow penetrates the portable 3-D archery target, wherein the portable 3-D archery target can be freely set upon a target-supporting surface in an unanchored manner, the portable 3-D archery target comprising:

a foam body having a weight, the foam body has a three-dimensional curved outer surface to provide at least some animal resemblance: the foam body includes a bottom surface that can be freely set upon the target-supporting surface, the foam body has a center of gravity at a height above the bottom surface, the bottom surface has a lower rear edge about which the foam body can pivot in reaction to being struck at the center of gravity by the arrow delivering the impact force of at least 20 pounds of force, the impact force times the height imparts a tipping rotational moment that urges the foam body to pivot about the rear edge, the weight of the foam body provides an anti-tipping rotational moment about the rear edge, wherein the anti-tipping rotational moment opposes the tipping rotational moment, the tipping rotational moment is greater than the anti-tipping moment, however, the foam body has a quality such that most of the 100 in-lbs of kinetic energy is absorbed within the foam body so that there is insufficient remaining kinetic energy left to completely tip over the foam body, and further wherein the foam body comprises an upper section and a lower section, the upper section has a maximum horizontal cross-sectional area, the lower section defines a horizontal base envelope that is smaller than the maximum horizontal cross-sectional area, an intermediate horizontal cross-sectional area is interposed between the upper section and the lower section, and the intermediate horizontal cross-sectional area is smaller than the maximum horizontal cross-sectional area and is smaller than the horizontal base envelope.

2. The portable 3-D archery target of claim 1, wherein at least 90% of the kinetic energy of the arrow is converted to heat that is absorbed by the foam body.

3. The portable 3-D archery target of claim 1, wherein the foam body includes an alternate geometric target area that is more planar than the three-dimensional curved outer surface.

4. A portable 3-D archery target adapted to be set upon a target-supporting surface and adapted to being struck and penetrated by an arrow that can exert an impact force of at least 20 pounds when the arrow strikes the portable 3-D target with sufficient kinetic energy, the portable 3-D archery target comprising:

a foam body having a weight and being selectively movable to an upright position and a tipped-over position, wherein the foam body comprises an upper section and a lower section, the upper section has a maximum horizontal cross-sectional area, the lower section defines a horizontal base envelope that is smaller than the maximum horizontal cross-sectional area, an intermediate horizontal cross-sectional area is interposed between the upper section and the lower section, and the intermediate horizontal cross-sectional area is smaller than the maximum horizontal cross-sectional area and is smaller than the horizontal base envelope;

the foam body has a three-dimensional curved outer surface to provide at least some animal resemblance;

the foam body includes a bottom surface that can be freely set upon the target-supporting surface to place the foam body in the upright position;

the foam body has a center of gravity at a height above the bottom surface when the foam body is in the upright position;

the bottom surface has a lower rear edge about which the foam body can pivot from the upright position toward the tipped-over position in reaction to a tipping rotational moment created by a 20-pound horizontal force being exerted against the foam body toward the center of gravity;

the weight of the foam body provides an anti-tipping rotational moment about the rear edge when the foam body is in the upright position, wherein the anti-tipping rotational moment opposes the tipping rotational moment when the foam body is in the upright position and is experiencing the 20-pound horizontal force;

the tipping rotational moment created by the 20-pound horizontal force is greater than the anti-tipping moment when the foam body is in the upright position; and the tipping rotational moment is sufficient to tip the foam body completely over from the upright position to the tipped-over position if the 20-pound horizontal force is exerted for a period of at least one second; however, the foam body has a shape and a foam density that enables the anti-tipping moment to prevent the foam body from tipping completely over to the tipped-over position if the 20-pound horizontal force is exerted for a period of less than 5 milliseconds.

5. The portable 3-D archery target of claim 4, wherein the anti-tipping moment is sufficient to substantially prevent the foam body from tipping about the rear edge from the upright position to the tipped-over position when a 3-pound horizontal force is exerted against the foam body toward the center of gravity.

6. The portable 3-D archery target of claim 4, wherein the foam body has a density appreciably greater than 6 pounds per cubic foot.

7. The portable 3-D archery target of claim 4, wherein the foam body has an overall height that is less than twice the height of the center of gravity.

8. The portable 3-D archery target of claim 4, wherein the bottom surface is concave to create an outer peripheral rim that engages the target-supporting surface when the foam body is placed thereon.

9. The portable 3-D archery target of claim 4, further comprising a handle attached to an upper section of the foam body.

10. The portable 3-D archery target of claim 9, wherein the handle includes a rope with spread-out stranded ends that are embedded within the foam body.

11. The portable 3-D archery target of claim 4, wherein the foam body includes an alternate geometric target area that is more planar than the three-dimensional curved outer surface.

* * * * *